US009976752B2

(12) United States Patent
Töpfer

(10) Patent No.: US 9,976,752 B2
(45) Date of Patent: May 22, 2018

(54) DETERGENT CARTRIDGE FOR CLEANING DEVICE IN OVENS

(71) Applicant: I-CLEAN TECHNOLOGIES GMBH, Hockenheim (DE)

(72) Inventor: Rüdiger Töpfer, Hockenheim (DE)

(73) Assignee: I-CLEAN TECHNOLOGIES GMBH, Hockenheim (CH)

( * ) Notice: Subject to any disclaimer, the term of this patent is extended or adjusted under 35 U.S.C. 154(b) by 0 days. days.

(21) Appl. No.: 15/105,699

(22) PCT Filed: Dec. 18, 2014

(86) PCT No.: PCT/EP2014/078473

§ 371 (c)(1),
(2) Date: Jun. 17, 2016

(87) PCT Pub. No.: WO2015/091803

PCT Pub. Date: Jun. 25, 2015

(65) Prior Publication Data

US 2016/0341431 A1 Nov. 24, 2016

(30) Foreign Application Priority Data

Dec. 20, 2013 (DE) ..... 10 2013 021 732

(51) Int. Cl.
*A47L 15/44* (2006.01)
*F24C 14/00* (2006.01)
(Continued)

(52) U.S. Cl.
CPC ..... *F24C 14/005* (2013.01); *B05B 3/06* (2013.01); *B05B 7/2462* (2013.01); *B08B 3/08* (2013.01); *B08B 3/14* (2013.01); *B08B 9/0936* (2013.01)

(58) Field of Classification Search
CPC ..... F24C 14/005; B05B 3/06; B08B 9/0936; A47L 15/23; A47L 15/4282
(Continued)

(56) References Cited

U.S. PATENT DOCUMENTS 3,610,532 A 10/1971 Modrey
3,770,203 A * 11/1973 Dyar ..... B05B 15/10 134/179

(Continued)

FOREIGN PATENT DOCUMENTS

DE 60107104 T2 1/2006
DE 102006025508 A1 12/2006

(Continued)

OTHER PUBLICATIONS

International Search Reported dated Mar. 5, 2015 issued in PCT/EP2014/078473.

*Primary Examiner* — David G Cormier
*Assistant Examiner* — Thomas Bucci
(74) *Attorney, Agent, or Firm* — Kilpatrick Towsend & Stockton LLP

(57) ABSTRACT

The invention relates to a cleaner cartridge for cleaning a soiled interior of an appliance, comprising:

Figure 1:
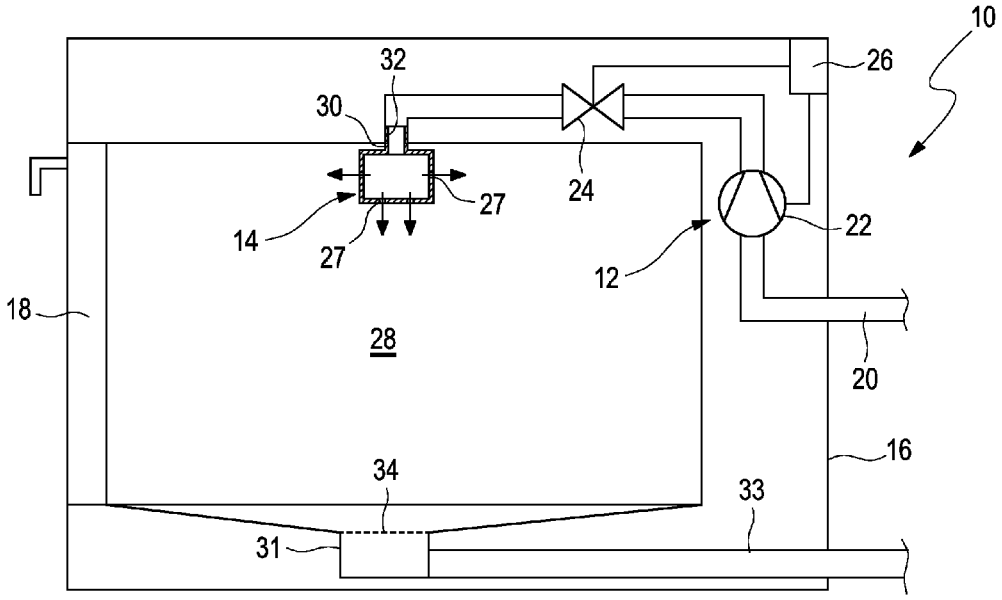

an integral housing for holding a treatment agent, at least one receptacle for connecting the cleaner cartridge to a water supply, wherein water can be introduced into the housing via the receptacle at a pressure which enables a treatment agent mixture to be sprayed, and at least one spray opening for spraying a treatment agent mixture, wherein the at least one spray opening is arranged as a rotation opening in the circumference-of the housing in such a way that rotation is imparted to the cleaner cartridge as a treatment agent mixture is sprayed.

(Continued)

The invention furthermore relates to an appliance having a cleaner cartridge of this kind and to the use of a cleaner cartridge for cleaning appliances.

12 Claims, 9 Drawing Sheets

(51) Int. Cl.

| | |
|---|---|
| ***B08B 9/093*** | (2006.01) |
| ***B05B 3/06*** | (2006.01) |
| ***B05B 7/24*** | (2006.01) |
| ***B08B 3/08*** | (2006.01) |
| ***B08B 3/14*** | (2006.01) |

(58) Field of Classification Search
USPC ..... 134/167 R, 179, 22.18, 198, 22.1, 93, 134/176, 172, 166 R, 24, 168 R; 239/251, 227, 310, 224, 223, 240, 600, 239/589, 206, 581.1, 246; 222/190, 148, 222/144, 129, 145.5, 165, 325, 82
See application file for complete search history.

(56) References Cited

U.S. PATENT DOCUMENTS 4,828,651 A 5/1989 Lumbroso et al.
5,211,337 A * 5/1993 Lukez ..... B08B 9/0936 239/251
5,785,248 A * 7/1998 Staylor ..... B05B 15/008 239/237
5,906,316 A * 5/1999 Gatzemeyer ..... B05B 1/3442 137/268
5,954,271 A * 9/1999 Le ..... B05B 3/0445 239/227
5,957,387 A * 9/1999 Porta ..... B05B 1/1618 239/310
8,079,533 B2 * 12/2011 Bowen ..... B05B 3/06 239/237
2002/0027171 A1 * 3/2002 Crampton ..... A62C 31/12 239/246
2006/0054716 A1 * 3/2006 Lutzki ..... B05B 3/005 239/246
2008/0223357 A1 * 9/2008 Bartelick ..... B08B 9/00 126/21 A
2009/0178664 A1 7/2009 Valentine et al.
2010/0043849 A1 * 2/2010 Ross ..... B08B 9/0936 134/166 R
2010/0051057 A1 * 3/2010 Delaney ..... B05B 13/0636 134/10
2010/0072188 A1 * 3/2010 Lee ..... C03C 8/08 219/393
2011/0048470 A1 * 3/2011 van Krimpen ..... B05B 3/06 134/34
2011/0079254 A1 * 4/2011 Delaney ..... B05B 3/0445 134/198
2013/0146094 A1 * 6/2013 Riefenstein ..... B08B 3/04 134/22.1

FOREIGN PATENT DOCUMENTS

EP 1582265 A2 10/2005
EP 2502542 A1 9/2012
WO 2008/032138 A1 3/2008

* cited by examiner

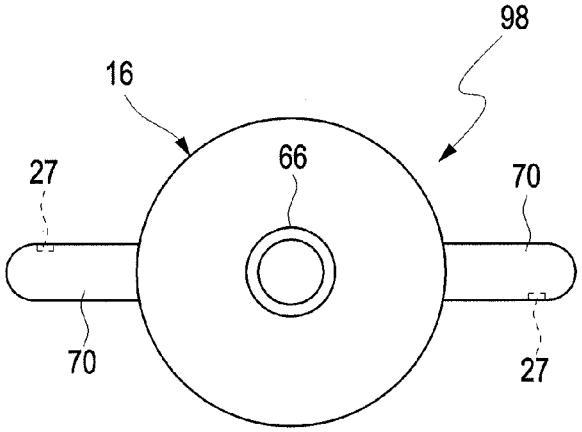
Fig. 10.1
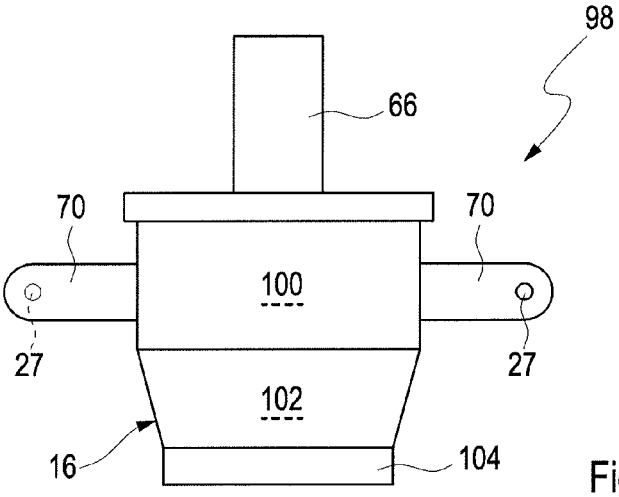
Fig. 10.2
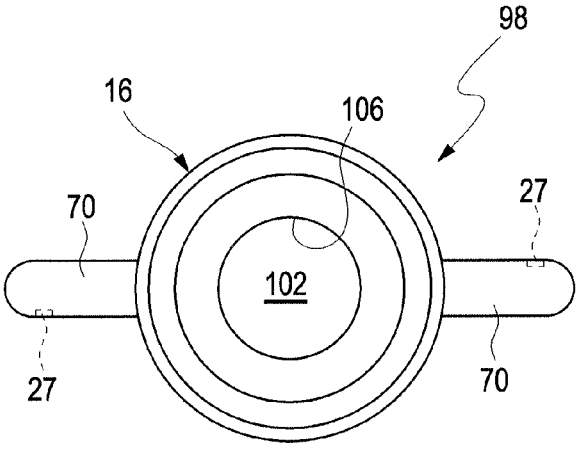
Fig. 10.3

DETERGENT CARTRIDGE FOR CLEANING DEVICE IN OVENS

CROSS REFERENCE TO RELATED APPLICATIONS

This application is a U.S. National Stage of International Application No. PCT/EP2014/078473, filed Dec. 18, 2014, which claims the benefit of German patent Application No. 10 2013 021 732.6, filed Dec. 20, 2013, the entire contents of which are incorporated herein by reference.

The invention relates to a cleaner cartridge for cleaning a soiled interior of an appliance, in particular of an oven or steamer. The invention furthermore relates to an appliance having a cartridge of this kind and to the use of a cleaner cartridge of this kind in a method for cleaning such appliances.

DE 10 2006 025 508 A1 relates to a cleaning system for cleaning a baking or combination steamer appliance. Dispensing containers that are filled or can be filled with liquid cleaning agents and/or cleaning agents converted into liquid form are positioned in the baking/cooking chamber. The dispensing containers are each connected to a compressed-air and/or pressurized-water feed line via a pipe and via regulating units controlled by a control device. Here, the dispensing containers are each connected to the baking/cooking chamber via an outlet pipe. A drainage tank arranged underneath the baking/cooking chamber is connected via a pipe and a circulating pump to at least one spray head accommodated in the baking chamber.

The disadvantage with this solution is the involved handling and its restriction to liquid cleaners. A solid cleaner must be converted into a liquid product manually by being dissolved outside the cooking chamber and outside the cartridge. Only then can a dispensing container be inserted into the cooking chamber and the liquid product released from the dispensing container and distributed by means of further devices, e.g. a fan impeller or a nozzle, which need to be mounted in a fixed manner in a cooker or an oven.

US 2010/0072188 A1 relates to a cooker. An enamel coating containing a phosphate-based additive is applied to an inner surface delimiting a cooking chamber. The inner surface of the cooking chamber is cleaned by using high-temperature cleaning water. It is thereby possible to perform cleaning of the walls of the cooking chamber in an effective manner.

WO 2008/032138 A1 relates to a washing device. The washing device is suitable, in particular, for cleaning chambers of a very wide range of appliances for industrial and domestic applications. The washing device essentially comprises a rotation element constructed from disk-shaped elements mounted on a bearing bush. The washing fluid is fed in via the bearing bush. The disk-shaped parts are shaped in such a way that, when they are supplied with the washing fluid, a number of rotating washing jets is directed at various impact surfaces and also strikes the surfaces of objects. The complex construction of the washing device described here and its complex routing of the fluid make this washing device very susceptible to clogging by dirt particles or low-solubility constituents of the cleaner, and this can lead to associated blocking of the rotation.

EP 1 582 265 A2 relates to a dispenser apparatus. A collecting body collects fluid to be dispensed, which is distributed by means of a suitable rotor. This static rotor is connected to the collecting body by a rotary coupling, wherein the collecting body is embodied in such a way that it accommodates within it a significant part of the body of the rotor. The rotary coupling parts comprise fastening means with a sealing washer, which are situated between the rotor and the collecting body.

In this solution too, the complex construction of the arrangement comprising a dispensing container and a rotation element is disadvantageous. Moreover, the small diameter of the nozzles means that they are susceptible to dirt and tend to become clogged if the washing liquor is dirty or solid cleaners are used. For this reason, use is limited to liquid products in the conventional spray and rinse process for cleaning ovens.

It is the object of the present invention to provide a simplified cleaning system for appliances, in particular those for heat treating foodstuffs, which is of simple design both in terms of construction and in terms of handling. Thus, minimizing the number of additional built-in parts is intended to ensure ease of servicing, and parts prone to failure are to be reduced or to be exchangeable as disposable components. Moreover, the intention is to achieve a high degree of hygiene without the need to remove loose dirt particles manually.

According to the invention, a cleaner cartridge for cleaning a soiled interior of an appliance, in particular for heat treating foodstuffs, in particular an oven or a steamer for heat treating foodstuffs, such as a steamer, is proposed, wherein the cleaner cartridge comprises:

- an integral housing for holding a treatment agent,
- at least one receptacle for connecting the cleaner cartridge to a water supply, wherein water can be introduced into the housing via the receptacle at a pressure which enables a treatment agent mixture to be sprayed, and
- at least one spray opening for spraying the treatment agent mixture, wherein the at least one spray opening is arranged as a rotation opening in the circumference of the housing in such a way that rotation is imparted to the cleaner cartridge as the treatment agent mixture is sprayed.

In particular, the cleaner cartridge is designed in such a way that cleaning of the soiled interior of the apparatus takes place without further nozzles. Here, a nozzle denotes a separate component with a narrowing conduit cross section, in which a medium flowing through, such as the treatment agent mixture, in particular a cleaning solution, increases in speed while simultaneously losing pressure. By virtue of integral embodiment of the housing with the receptacle for the water supply and of the arrangement of spray openings, the treatment agent mixture is prepared directly for spraying in a single component. Thus, in particular, the cleaner cartridge can be used directly for cleaning, without an additional nozzle or nozzle apparatus, and hence offers an all-in-one solution for a cartridge with an integrated nozzle unit, which additionally allows a flexible design of the cleaning system. Moreover, no additional internal fittings, such as further nozzles and nozzle conduits, are required in the appliance, and the number of failure-prone components is thereby minimized. Apart from the simplicity of the design, the cleaner cartridge is also user-friendly since the nozzle and the treatment agent reservoir are combined in a single component. Thus, the cleaner cartridge can be inserted into the appliance before the cleaning operation, and the operation can be started, thus allowing simple handling by the user.

In the present context, a cleaner cartridge denotes a cartridge which is preferably inserted into the appliance before the cleaning operation. Here, the cartridge can be designed as a reusable cartridge which is filled with treatment agent and inserted into the appliance before the cleaning operation. As an alternative, the cleaner cartridge can be designed as a disposable cartridge which is already filled with treatment agent and is inserted before each cleaning operation. Depending on the embodiment, the cleaner cartridge can thus hold sufficient treatment agent for one or more cleaning operations.

In one embodiment, the cleaner cartridge is designed as a reusable or disposable cartridge which holds a sufficient quantity of treatment agent for at least one cleaning operation and preferably for a single cleaning operation. For example, the cleaner cartridge can have a filling volume of 25 ml to 500 ml, preferably of 50 ml to 450 ml and particularly preferably of 75 ml to 300 ml. This enables the volume of the housing to be chosen so that treatment agent for just one cleaning operation can be held. Here, the requirement for treatment agent depends on the length of the cleaning operation and the volume to be cleaned.

Moreover, the housing of the cleaner cartridge can be embodied as a plastic housing. Housings of this kind can comprise a plastic, for example, such as polyvinylchloride (PVC), polyethylene (PE), especially polyethylene with a low degree of branching (high-density polyethylene, HDPE), polypropylene (PP), polytetrafluoroethylene (PTFE), polyamide, polystyrene, polyurethane, polyethylene terephthalate or mixtures thereof. The housing is preferably produced from a plastic which is not corroded by the treatment agents stored in the housing. Moreover, the housing is produced from a plastic which is resistant to the temperatures prevailing during the cleaning operation. Typical temperatures are 30° C. to 100° C., preferably 50° C. to 90° C., and particularly preferably 60° C. to 85° C. As an alternative, the housing of the cleaner cartridge can be designed as a metal housing.

The treatment agent can contain a cleaning agent and/or a descaling agent, for example. Suitable cleaning agents include, in particular, alkaline cleaning agents, which have a pH of >7, preferably between 9 and 13, in aqueous solution. Examples of frequently used components of alkaline cleaners are alkali metal hydroxides, alkali metal carbonates, phosphates, silicates, peroxides, percarbonates, methylglycinediacetic acid (MGDA), phosphates, polycarboxylates, enzymes or mixtures thereof. In addition, surface-active substances, such as surfactants, emulsifiers or inhibitors can be used. Common descaling agents can include citric acid, methanesulfonic acid (MSA), amidosulfonic acid, malic acid, maleic acid, tartaric acid, acetic acid or mixtures thereof, for example.

Moreover, the treatment agent can be held as granules, as powder, as gel, as a block, as a tablet or in liquid form in the housing. The treatment agent is preferably held as a tablet, granules, powder, block or gel in the housing to prevent it from accidentally escaping through the spray openings, e.g. during transportation.

Furthermore, the openings can be closed, e.g. with a removable film, a tearable film of a few μm or a water-soluble film. Moreover, the openings can be closed with a wax that melts at a certain temperature. Thus, the treatment agent can be released in a manner controlled by temperature. As an alternative, the openings can be closed by a water-soluble saccharide.

In another embodiment, the receptacle can be designed as a fixed or as a rotatable receptacle. The receptacle is preferably designed for coupling the cleaner cartridge to a cleaning system of the appliance. Thus, the receptacle can have a coupling, such as a screw coupling or a bayonet coupling. In the case of a fixed receptacle of the cleaner cartridge, for example, a connection element of the cleaning system can be of rotatable design. Conversely, it is also possible for the receptacle of the cleaner cartridge to be of rotatable design and for the connection element of the cleaning system to be fixed.

In another embodiment, the housing is embodied as a cylinder with a circumferential surface, a cartridge head and an underside. Here, the base surface of the cylinder can take on any shape, being round or polygonal for example. In this case, a polygonal shape, in particular a rectangular shape, or a housing in the form of a spray arm has the advantage that a larger distance from the axis of rotation and the greatest proximity to the side walls to be cleaned can be achieved for a given volume, as compared with a round shape. Stable rotation and a good cleaning result can thereby be achieved.

The receptacle can be arranged on the cartridge head of the housing. On an oppositely situated underside of the housing, the housing can be closed, or at least one spray opening can be arranged on the underside of the housing. The oppositely situated arrangement of the receptacle and the spray openings ensures that, during operation, water for dissolving the treatment agent, for example, is introduced via the receptacle into the housing and, as a result, the pressure within the cartridge increases to such an extent that the treatment agent mixture is sprayed through the spray openings.

To produce a rotary motion, the spray openings designed as rotation openings can be deformed inward in the direction of the tangents or can be embodied on a slope as recesses, with the result that the spray openings spray treatment agent mixture in a tangential direction. In another embodiment, at least two rotation openings are arranged in the circumferential surface of the housing in such a way that two tangentially oriented jets with opposite spray directions are produced during spraying. The rotation openings are designed in such a way that, in the case of a rotatably mounted cleaner cartridge, a rotary motion is imparted to the cleaner cartridge by the spraying of treatment agent mixture. As an alternative, one rotation opening can be sufficient if the torque produced owing to the distance of the outlet opening from the center of rotation initiates a rotary motion of the cleaner cartridge. It is advantageous here to provide one, two or three openings, for example, which can be given larger dimensions than, for example, more than three openings in order to spray a corresponding volumetric flow. Owing to the larger diameter, these are not clogged so easily by dirt particles.

In a preferred embodiment, the spray openings are arranged at regular intervals in the circumferential surface of the housing; as a particularly preferred option, two spray openings are arranged opposite one another in the circumferential surface of the housing, imparting rotation to the housing of the cleaner cartridge as the spray jets of the treatment agent mixture emerge.

In another embodiment, rotation elements can be arranged on the circumferential surface of the housing, assisting a rotary motion of the cleaner cartridge. In particular, the rotation elements are arranged opposite one another and comprise spray openings which act as rotation openings and produce the rotation of the housing. In this case, the spray openings can be arranged on respectively opposite sides in the two rotation elements in order to produce a spray jet in an opposite direction and thus initiate a rotary motion of the housing. By virtue of the rotation elements, the spray openings can be arranged in the rotation elements, and the volume of the cleaner cartridge is not reduced by a bevel in the circumferential surface.

In addition, the distance from the center of rotation is increased, and hence a higher torque is achieved as compared with spray openings integrated into the circumferential surface of the housing.

In another embodiment, additional spray openings can be arranged in the circumferential surface of the housing, the underside of the housing and/or in the rotation elements, said openings having a smaller diameter than the spray openings which bring about the rotation of the housing. The additional spray openings are preferably designed as holes in the circumferential surface of the housing. The additional spray openings assist the mechanical removal of dirt particles so as to reach problematic areas of the space to be cleaned.

In another embodiment, a retention device, e.g. a collecting screen, is arranged within the housing. By virtue of the integrated retention device, the cleaner cartridge can form a dirt collector in cleaning systems which have a recirculation circuit for the cleaning solution, this collector being removed together with the cleaner cartridge. This eliminates the need for additional measures to remove the dirt particles from the appliance interior to be cleaned after the cleaning operation. In addition, it is possible to dispense with a screening device or parts thereof built into the appliance. Thus, it may be sufficient, for example, to provide a coarse screen in the appliance to retain large scraps of food, such as bones, which might block a pump for instance.

A pump can preferably be cyclically controlled. Thus, the retention device in the cleaner cartridge can be freed from dirt particles again by a backflow, and it is possible to make the screening surface smaller in relation to the quantity of dirt particles. If, for example, a pump, such as a circulating pump, is cyclically controlled during the cleaning operation, e.g. operated every 20 seconds, so that there is no pumping in pauses of about 5 seconds, the dirt runs back out of the retention device situated within the cleaner cartridge into the conduit system of the cleaning system or onto the bottom of the interior of the appliance if there is no backflow prevention device. This leads to a backflow of the dirt particles, with the result that the retention device, such as the collecting screen, is freed from dirt again. Thus, circulatory pumping through the screening surface, which is of small dimensions relative to the quantity of dirt, is still possible, even if dirt levels in the appliance are high. During pumping out after the cleaning operation, a dirt particle floating at the bottom in the appliance can flow out into the outlet as well. Only particles on the wall and roof of the appliance are impossible to pump out in this way. However, deposition of detached particles on these surfaces is prevented by the collecting screen in the cleaner cartridge. In another embodiment, a backflow prevention device is additionally arranged within the housing as well as the retention device in order to avoid dirt particles flowing back into the cleaning system. A backflow prevention device can comprise a check valve integrated into the cleaning system of the appliance, for example. The backflow prevention device can also be implemented by a membrane as a dirt trap in the interior of the appliance and, in particular, in the cleaner cartridge, said membrane closing as the treatment mixture flows back. This makes it possible to ensure that dirt particles are collected within the cleaner cartridge and are decoupled completely from the cleaning system after the removal of the cleaner cartridge. In this way, the hygiene conditions in the cleaning system can be improved. Also according to the invention, an appliance, in particular for heat treating and, very particularly, a steamer or an oven, having a cleaning system is proposed, wherein means for accommodating the above-described cleaner cartridge are provided in an appliance interior to be cleaned.

In this case, the above-described cleaner cartridge can be capable of being coupled to a water supply via a connection element of the cleaning system. It is preferably possible for the receptacle to be connected to the connection element of the above-described cleaner cartridge. In particular, the above-described cleaner cartridge is provided in the interior to be cleaned, wherein the receptacle is coupled to the connection element.

Depending on the embodiment of the cleaner cartridge, the appliance, in particular an oven, such as a steamer, can comprise a cleaning system embodied in various ways. The cleaning system of the appliance preferably comprises at least one water supply in order to carry water under pressure into the cleaner cartridge, and an outlet line in order either to discharge water from the interior or to feed it back into the cleaning process via a recirculation line.

The water supply can be provided via a freshwater line or a tank in the appliance, for example. A pump can furthermore be provided to deliver the water into the cleaner cartridge, delivering water into the cleaner cartridge from the tank, for instance, or from the fresh water line via conduits of the cleaning system.

In another embodiment, the connection element is of rotatable or static design. If the cleaner cartridge comprises a static connecting element, for example, the connection element of the cleaning system to which the cleaner cartridge can be coupled can be of rotatable design, e.g. being designed with a rotor. Conversely, if the cleaner cartridge comprises a rotatable connecting element, for example, the connection element in the cleaning system to which the cleaner cartridge can be coupled can be of non-rotatable design.

Moreover, an outlet containing a screen can be provided in the interior of the appliance in order to collect dirt particles and keep them away from the cleaning system. This screen collects the dirt particles and can be emptied after the cleaning operation.

In one embodiment, the cleaner cartridge can be arranged laterally, at the top or at the bottom in the interior of the appliance. The cartridge is preferably arranged in a central region of a lateral, upper or lower appliance wall delimiting the interior in order to develop a cleaning effect which is as great as possible. The cleaner cartridge is preferably arranged on an upper wall in the interior of the appliance in order to develop the greatest possible cleaning effect.

In another embodiment, the water supply provides water in a pressure range which makes it possible also to achieve a mechanical cleaning effect during the spraying of the dissolved treatment agent. For example, the pump can produce a pressure of 0.1 bar-4.0 bar, preferably of 0.2 bar-2.0 bar. In order to achieve better wetting and distribution of the treatment agent mixture in the interior of the steamer or of the oven or the like, the pump can also operate with alternating pressures.

Moreover, the use of the above-described cleaner cartridge in a process for cleaning an interior of an appliance is proposed according to the invention. For cleaning, the above-described cleaner cartridge can be coupled to a cleaning system of the appliance before the beginning of the cleaning operation, at least one cleaning cycle can be started, and the cleaner cartridge can be removed on completion of the cleaning operation. During the cleaning operation, the cleaner cartridge can be supplied with water, which forms a treatment agent mixture with the treatment agent held in the cleaner cartridge and is sprayed through the spray openings.

The features described in the context of the cleaner cartridge apply correspondingly to the appliance for cleaning an appliance interior. Conversely, the features described in the context of the appliance for cleaning a soiled interior of the appliance apply correspondingly to the cleaner cartridge.

ILLUSTRATIVE EMBODIMENTS OF THE INVENTION

Figure 2:
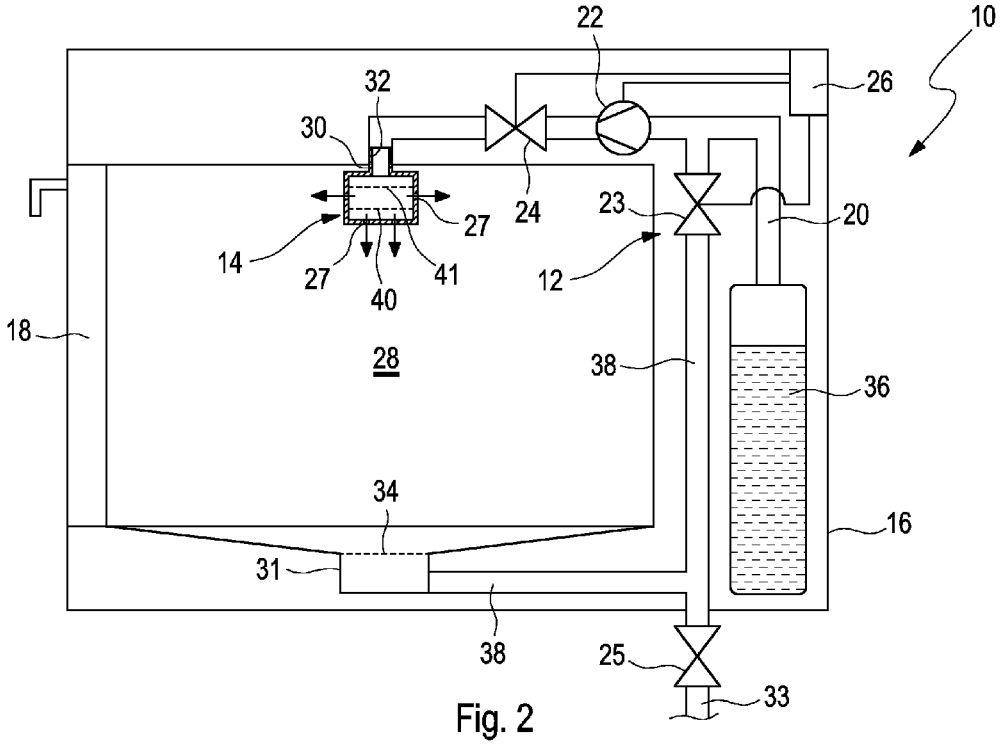
Figure 3A:
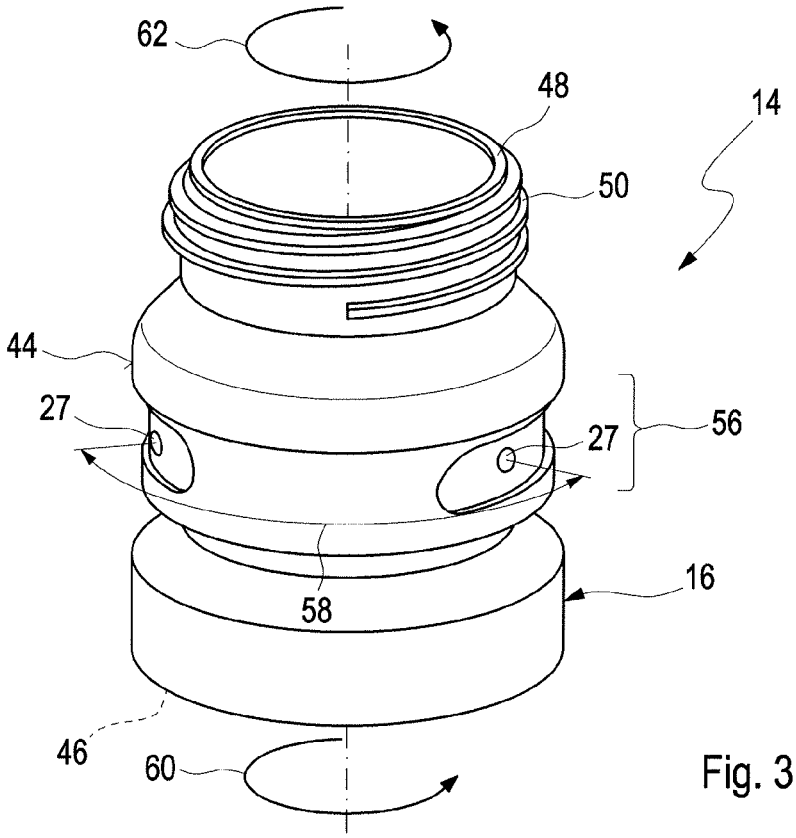
Figure 3B:
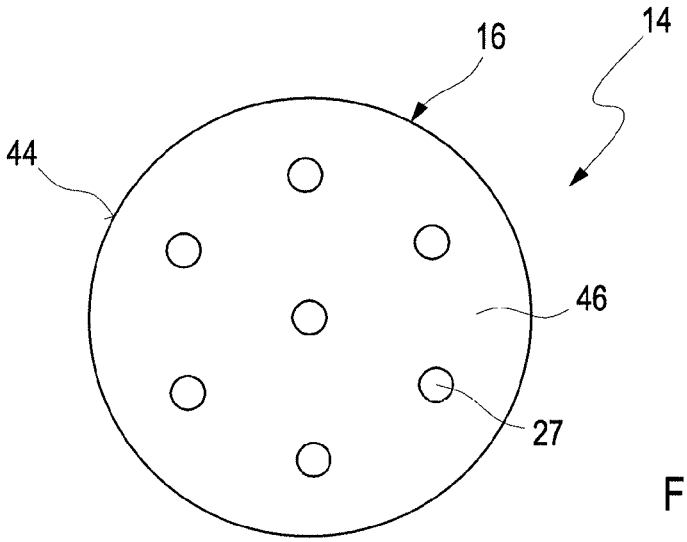
Figure 4A:
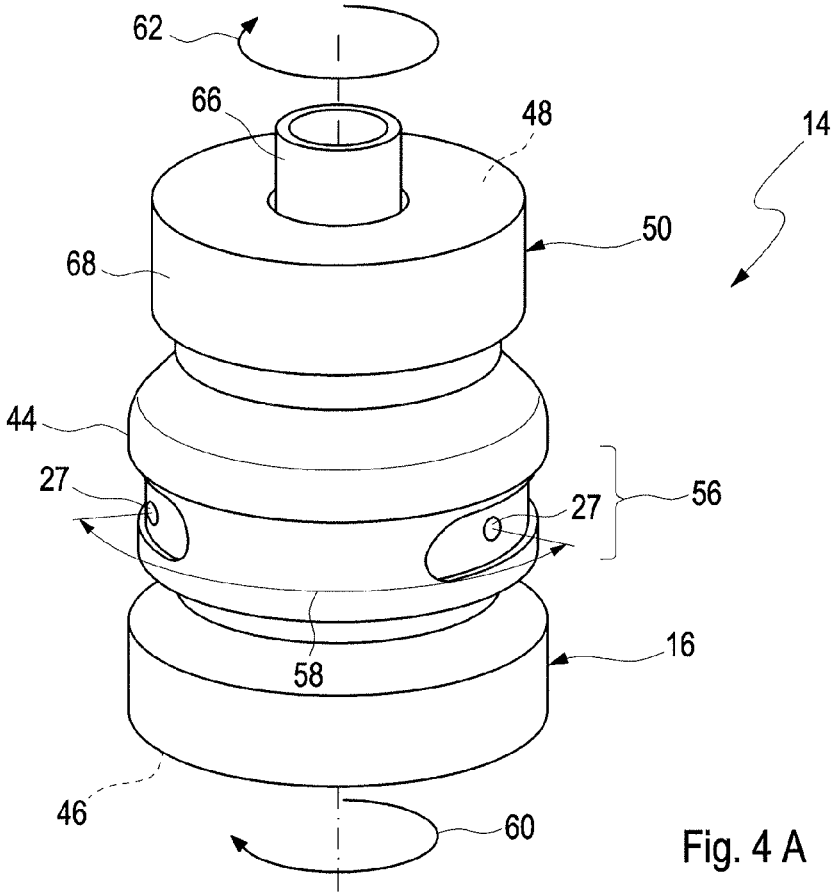
Figure 4B:
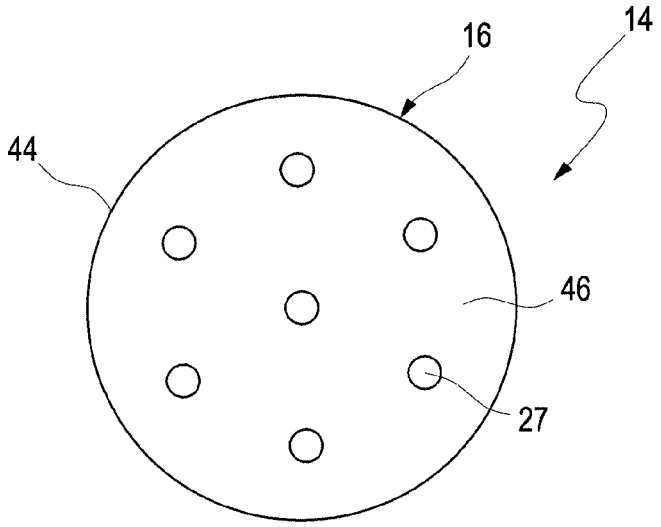
Figure 4C:
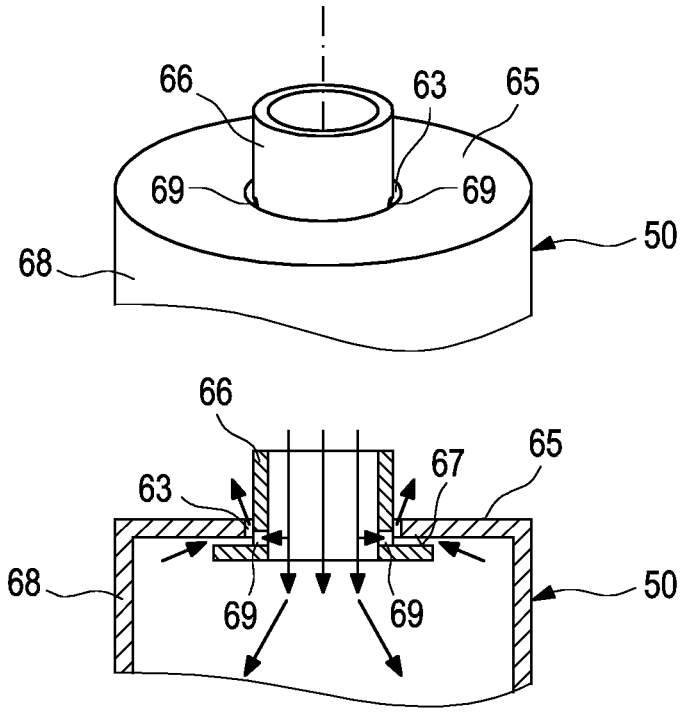
Figure 5A:
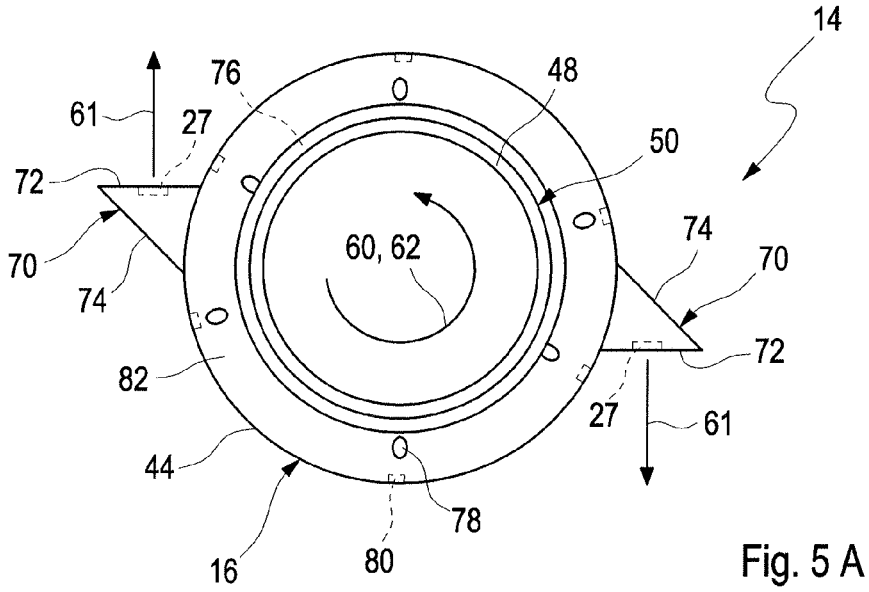
Figure 5B:
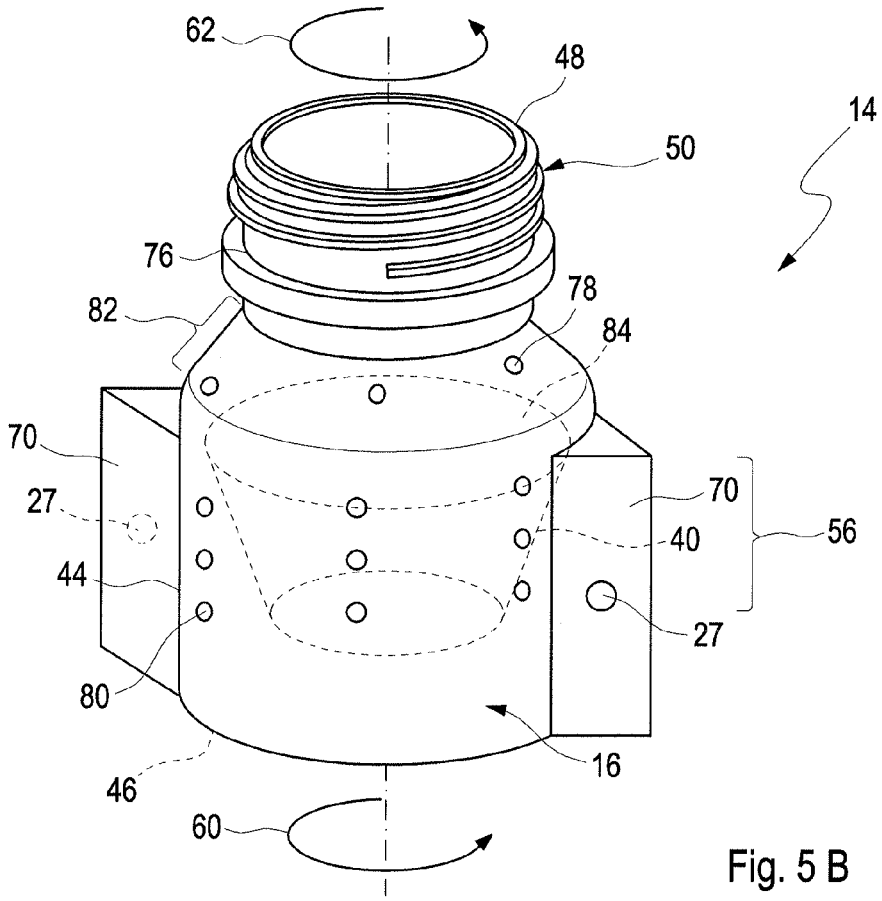
Figure 6A:
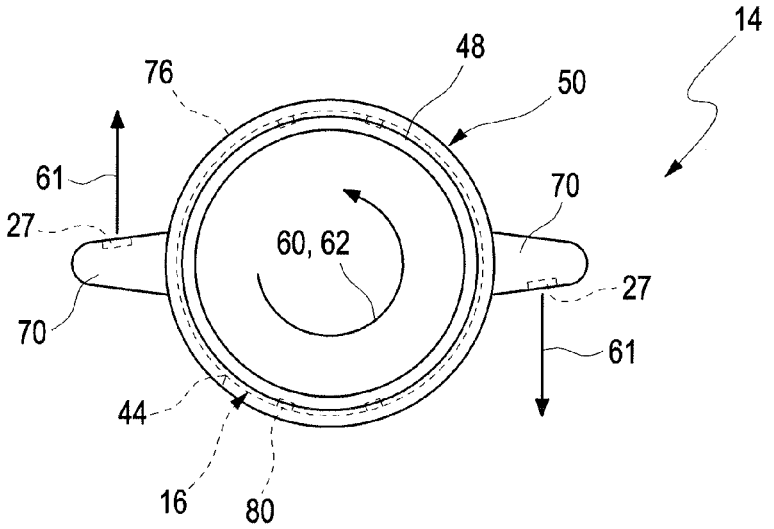
Figure 6B:
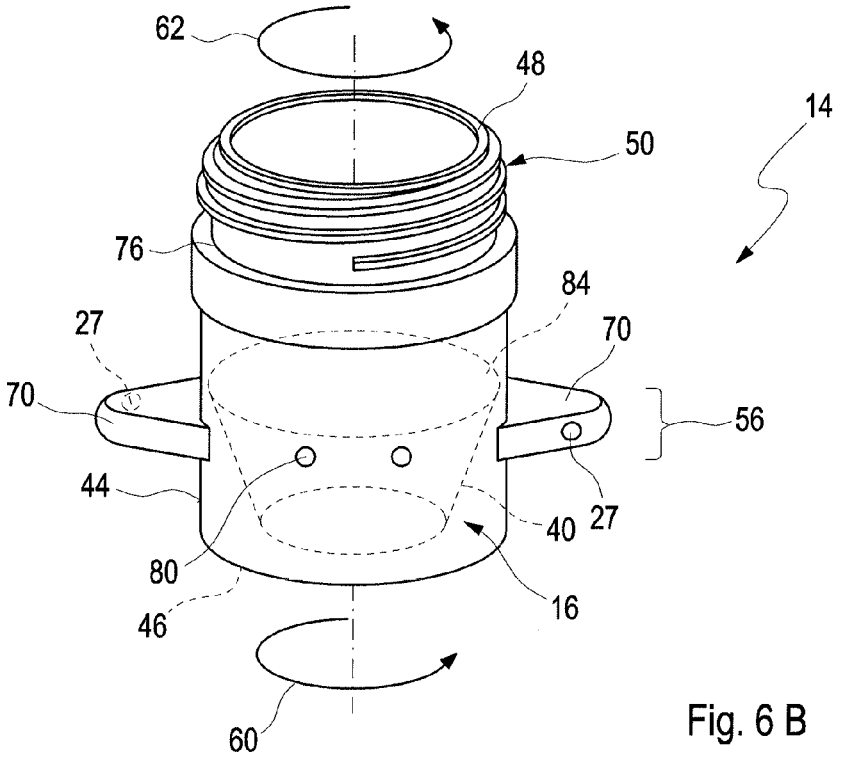
Figure 6C:
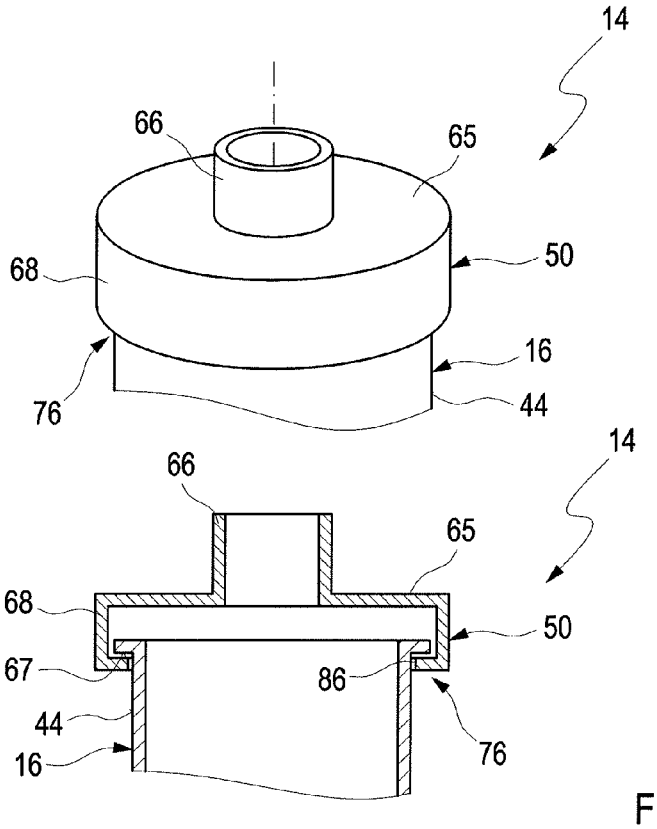
Figure 7:
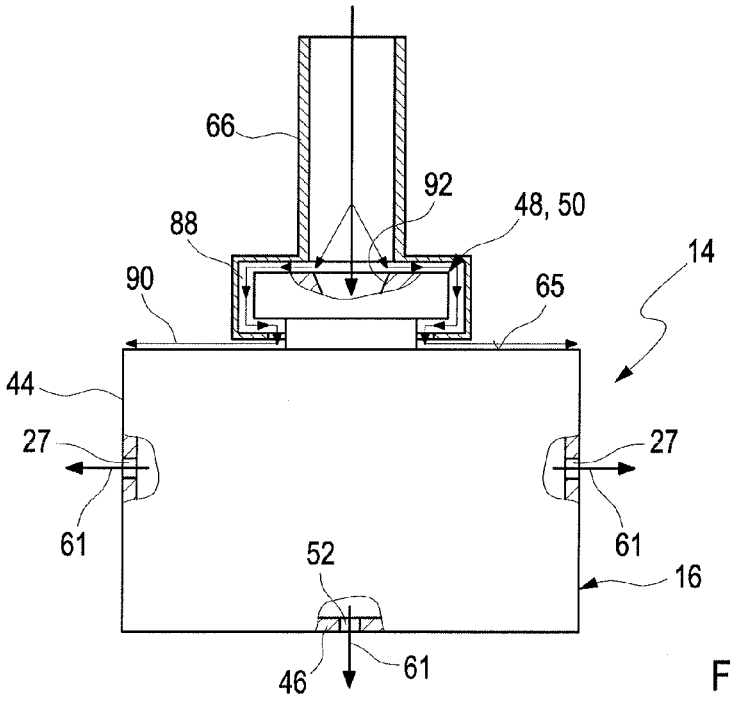
Figure 8:
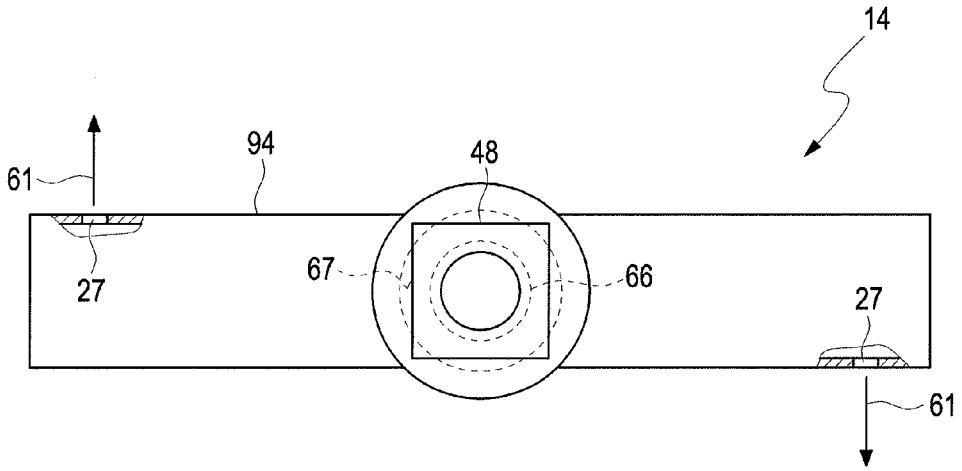
Figure 9:
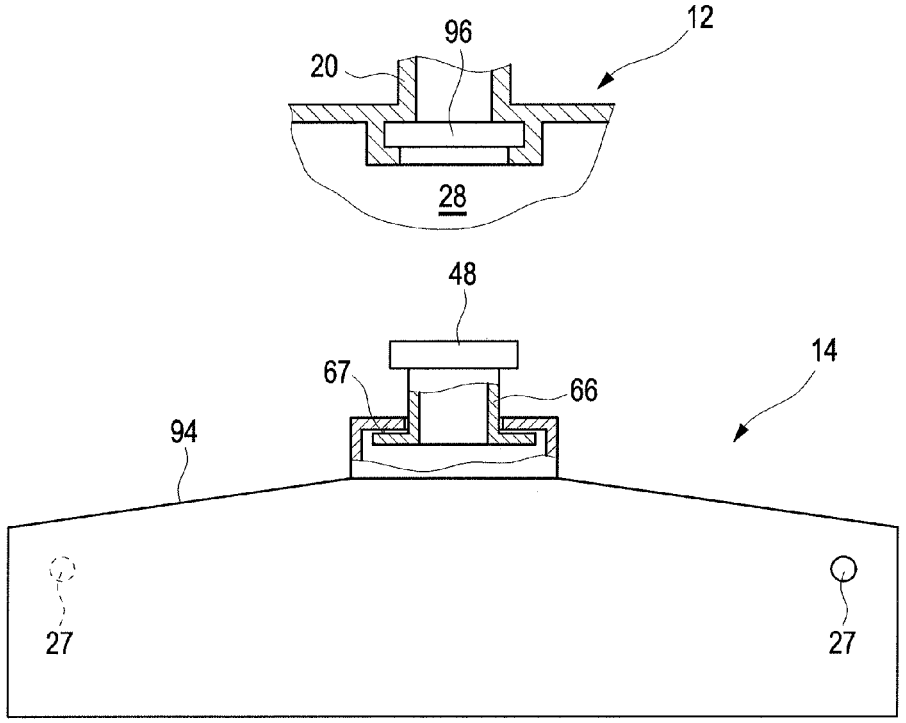

Illustrative embodiments of the invention are explained in greater detail below by means of the drawings, in which:

FIG. 1 shows an appliance to be cleaned, e.g. a steamer or an oven, having an illustrative cleaning system, FIG. 2 shows an appliance to be cleaned, e.g. a steamer or an oven, with another illustrative cleaning system, FIGS. 3A and 3B show a first embodiment of a cleaner cartridge, FIGS. 4A and 4B show another, second embodiment of a cleaner cartridge, FIG. 4C shows a possibility for connection between a receptacle of the cleaner cartridge and a bearing journal, FIGS. 5A and 5B show another, third embodiment of a cleaner cartridge, FIGS. 6A, 6B and 6C show another, fourth embodiment of the cleaner cartridge, FIG. 6C showing an embodiment in which the bearing journal is situated between the receptacle and the cleaner cartridge and forms a support or rotation surface, FIG. 7 shows a variant of the cleaner cartridge having a positive-locking connection, FIGS. 8 and 9 show a plan view and a side view of a cleaner cartridge embodied in the form of a spray arm, and FIGS. 10.1 to 10.3 show a cleaner cartridge embodied as a two-chamber cartridge

VARIANT EMBODIMENTS

In the following description, identical or similar reference signs are used for identical or similar components, while repeated description is dispensed with in individual cases. The drawings illustrate the subject matter of the invention only schematically.

FIG. 1 shows an embodiment of a cleaning system 12 in an appliance to be cleaned, e.g. in the interior of a steamer 10 or of an oven having a cleaner cartridge 14.

The appliance 10 to be cleaned, e.g. a steamer or an oven, comprises a housing 16, which is of two-part design with a door 18 that can be closed in a sealed manner. Provided in the housing 16 is a cleaning system 12, which carries out the cleaning operation. The cleaning system 12 comprises a supply line 20, a pump 22, a valve 24 and a control unit 26 for controlling the water supply. The cleaning system 12 can furthermore be coupled to a cleaner cartridge 14, which stores a treatment agent. A cleaning agent and/or a descaling agent in the form of a tablet, of granules, of a liquid, of a powder or block or of a gel, for example, are held as a treatment agent in the cleaner cartridge 14. For coupling the cleaner cartridge 14 to the cleaning system 12, the cleaner cartridge 14 comprises a connecting element 30, which is coupled, e.g. screwed, to the supply line 20 by means of a connection element 32.

If a cleaning operation is to be started, the cleaner cartridge 14 is coupled to the connection element 32 of the cleaning system 12, and the water supply is controlled by a control unit 26 via the valve 24 and the pump 22. When the cleaning operation is started, water is pumped from the supply line 20 on the delivery side into the cleaner cartridge 14, as a result of which the treatment agent dissolves in the water. A treatment agent mixture which forms during this process is sprayed into the interior 28 through spray openings 27 in the cleaner cartridge 14.

By spraying the dissolved treatment agent mixture, dirt on the inside of the housing 16 in the interior 28 of the appliance 10 to be cleaned, e.g. a steamer or an oven, is removed. Here, removal of dirt is accomplished both mechanically and chemically. The dirty water running off is discharged via an outlet 31 in the bottom of the housing 16. Dirt particles are collected in a screen 34, which is arranged upstream of the outlet 31, and can be removed manually on completion of the cleaning operation. On completion of the cleaning operation, the cleaner cartridge 14 is removed from the cleaning system 12, and the appliance 10 to be cleaned, e.g. a steamer or an oven, is once again available.

FIG. 2 shows a second embodiment of a cleaning system 12 in an appliance 10 to be cleaned, e.g. a steamer or an oven, having a cleaner cartridge 14.

The appliance 10 to be cleaned, e.g. a steamer or an oven, in accordance with FIG. 2, corresponds substantially to that shown in FIG. 1. As a departure from the appliance 10 to be cleaned, e.g. a steamer or an oven, in accordance with FIG. 1, the cleaning system 12 is fitted with a water tank 36. The water tank 36 stores a quantity of water at least sufficient to enable a complete cleaning operation to be carried out. After the cleaning operation, the water tank 36 must be refilled with water. In other embodiments, the water tank 36 can also be connected to a supply line (not shown) in order to fill the water tank 36 directly. In addition, in contrast to FIG. 1, the cleaning system 12 comprises a return 38, which connects the outlet 31 to the supply line 20 or to the outlet line 33, depending on the position of the valves 23, 25.

In this embodiment too, a cleaner cartridge 14 is coupled to the cleaning system 12 before the start of the cleaning operation. When valve 24 is open, water is pumped out of the water tank 36 into the cleaner cartridge 14 by the pump 22. The treatment agent and the water form a dissolved treatment agent mixture, which is distributed in the interior 28 of the appliance 10 to be cleaned, e.g. a steamer or an oven, by the spray openings 27. By spraying the dissolved treatment agent mixture, dirt on the inside of the housing 16 is partially dissolved and is removed. Here, the removal of dirt is accomplished both mechanically and chemically. The dirty water flowing off is passed via the outlet 31 into the outlet line 33 or, via a return 38, back into the cleaner cartridge 14.

To collect dirt particles and to avoid redistributing them in the interior 28 of the appliance 10 to be cleaned, e.g. a steamer or an oven, a collecting screen 40 is arranged in the cleaner cartridge 14. Thus, dirt particles from the dirty water are collected in the cleaner cartridge 14. In addition, a backflow prevention device, which has a membrane 41, can additionally be provided between the collecting screen and the water supply. Here, the membrane 41 is designed in such a way that water and dirt particles can pass through in one pumping direction and are retained in the opposite direction. The cleaning solution can run out through the screen and the spray openings 52, while the dirt particles are retained in the collecting screen. As an alternative to the membrane 40, it is also possible to provide a check valve (not shown) in the supply line 20.

On completion of the cleaning operation, the cleaner cartridge 14, including the dirt particles, is removed from the interior 28 of the appliance 10 to be cleaned, e.g. a steamer or an oven.

FIGS. 3A and 3B show a first embodiment of a cleaner cartridge 14, which can be used in the appliance 10 to be cleaned, e.g. a steamer or a furnace, in accordance with FIG. 1 or 2. Here, FIG. 3A shows the cleaner cartridge 14 in perspective and FIG. 3B shows a plan view of the underside of the cleaner cartridge 14.

The cleaner cartridge 14 comprises a housing 42, which is embodied in a cylindrical form with a circumferential surface 44, a cartridge head 48 and an underside 46. The cartridge head 48 of the housing 42 is designed as a receptacle 50, which can be coupled to the supply line 20 of the cleaning system 12. In the embodiment illustrated, the receptacle 50 is designed as a simple screw coupling. In corresponding fashion, the supply line 20 of the cleaning system 12 comprises a screw coupling of complementary design as a connection element 32. The cleaner cartridge 14 shown in FIG. 3 can be connected non-rotatably to the connection element 32 of the cleaning system 12. As an alternative, the connection element 32 of the cleaning system 12 can be of rotatable design.

The underside 46 of the housing 42 comprises spray openings 52, as shown in FIG. 3B of the cleaner cartridge 14. Spray openings 54 are furthermore provided in the circumferential surface 44 of the housing 42. According to FIG. 3A, the spray openings 54 are arranged at regular intervals 58 with respect to one another within a central region 56 of the housing 42.

The spray openings 54 are arranged in such a way that a tangential force component is produced during the spraying of the dissolved treatment agent mixture. For this purpose, the housing 42 is deformed inward in the central region 56, in particular in the region of the spray openings 54, in the direction of the tangents or is embodied on a slope as a recess, with the result that the spray openings 54 spray treatment agent mixture in a tangential direction. If the cleaner cartridge 14 is connected to a rotatable connection element 32, the spraying of the dissolved treatment agent mixture via the spray openings 54 arranged in the circumference 44 produces a tangential force component which results in a rotation direction 60 of the cleaner cartridge 14.

In this way, the interior 28 of the appliance 10 to be cleaned, e.g. a steamer or an oven, can be wetted uniformly with the dissolved treatment agent mixture from the cleaner cartridge 14. In order to prevent opening of the screw coupling between the receptacle 50 and the connection element 32 of the cleaning system 12, the chosen rotation direction 60 of the cartridge is identical with a screw-in direction 62 of the receptacle 50.

FIGS. 4A and 4B show another, second embodiment of a cleaner cartridge 14, which can be used in the appliance 10 to be cleaned, e.g. a steamer or an oven, from FIG. 1 or 2.

The cleaner cartridge 14 according to FIGS. 4A and 4B corresponds substantially to the cleaner cartridge 14 according to FIGS. 3A and 3B. In contrast to FIGS. 3A and 3B, the receptacle 50 of the cleaner cartridge 14 is embodied so as to be rotatable rather than non-rotatable. Accordingly, the connection element 32 of the cleaning system 12 for a cleaner cartridge 14 of this kind is of static design. To connect the receptacle 50 to the connection element 32 of the cleaning system 12, the receptacle 50 comprises a bearing journal 66 and a screw coupling body 68 for fixing to the connection element 32 of the cleaning system 12. In this embodiment, the screw-in direction 62 of the screw coupling body 68 and the rotation direction 60 of the cleaner cartridge 14 are identical.

The bearing journal 66 is screwed into the corresponding connection element 32 of the cleaning system. The bearing journal 66 therefore has either an internal thread or an external thread at the upper end. When using a disposable cleaner cartridge, the screw coupling body 68, for its part, must be impossible to open and can be connected in a fixed manner to the cleaner cartridge 14. If, on the other hand, a cleaner cartridge 14 embodied as a reusable cartridge is used, the screw coupling body 68 is provided with a thread in order to be able to separate the screw coupling body 68 from the cleaner cartridge 14 for refilling.

FIG. 4C shows one possibility for connecting the receptacle and a bearing journal.

FIG. 4C shows that an inner annular gap 63 extends between a flat surface 65 of the receptacle and the bearing journal 66. The inner annular gap 63 on the one hand ensures adequate radial clearance, allowing the receptacle 50 to rotate about the bearing journal 66 and, on the other hand, the formation of an inner annular gap 63, as shown in FIG. 4C, allows the formation of a fluid film. This fluid film which forms during the operation of the cleaning system between the inside of the flat surface 65 of the receptacle, the upper side of the supporting surface 67 of annular design on the bearing journal 66 and the inner annular gap 63 reduces friction and thus acts as a sliding bearing.

FIG. 4C furthermore shows that a supporting surface 67 of annular design extends on the end of the bearing journal 66, which is situated in the receptacle 50. This supporting surface 67 on the lower end of the bearing journal 66 supports the receptacle 50 of the cleaner cartridge 14, the receptacle being of rotatable design here. From the arrows drawn in FIG. 4C, which symbolize the fluid flow, it is evident that the inner annular gap 63 enables fluid to get onto the flat surface 65 of the receptacle 50 from the interior of the cleaner cartridge 14 via the supporting surface 67 and the annular gap 63 situated above the latter.

From the illustration according to FIG. 4C, it can furthermore be seen that at least one fluid passage opening 69 can additionally be situated at the bearing journal 66, at the lower end of which the supporting surface 67 is situated. This opening assists the formation of a fluid film on the upper side of the flat surface 65 of the receptacle 50 and between the upper side of the supporting surface 67 of annular design and the underside of the flat surface 65. FIG. 4C furthermore shows the flow conditions which establish themselves above the supporting surface 67 at the lower end of the bearing journal 66 and owing to the provision of the fluid passage opening 69 in the lateral surface of the bearing journal 66.

FIGS. 5A and 5B show a third embodiment of a cleaner cartridge 14 with rotation elements 70. Here, FIG. 5A shows a plan view of the cleaner cartridge 14 and FIG. 5B shows a side view of the cleaner cartridge 14. The third embodiment shown in FIGS. 5A and 5B is screwed by means of the receptacle 50, which in this variant embodiment has an external thread, into a threaded section situated on the roof of the interior 28 of the appliance 10 to be cleaned, e.g. a steamer or an oven. The housing 42 of the cleaner cartridge 14 rotates relative to the receptacle 50 about a rotary bearing 76 of the cleaner cartridge 14.

Apart from the spray openings 27, the cleaner cartridge 14 additionally comprises two mutually opposite blade-shaped rotation elements 70, for example, on the Here, the rotation elements 70 are designed in such a way that uniform rotation of the housing 16 of the cleaner cartridge 14 relative to the receptacle 50 is possible since the rotary bearing 76 is provided. In particular, the rotation elements 70 are designed with a triangular cross section, wherein the rotation elements 70 have a straight side 72 in the rotation direction 60. Moreover, one side 74 is of oblique design. The spray openings 54 are arranged in the straight side 72 of the rotation elements 70.

FIG. 5B shows a side view of the cleaner cartridge 14, which comprises a receptacle 50, which is secured on the connection element 32 of the supply line 20 of the cleaning system 12. The receptacle 50 is furthermore designed as a screw head, wherein the rotary bearing 76 is formed in the receptacle 50.

The cleaner cartridge 14 comprises spray openings 78, 80, 54 in different regions and of different sizes in the circumference 44 of the housing 42. The spray openings 78 are provided in a beveled region 82 of the housing 42, within which the circumference of the housing 42 decreases toward the receptacle 50. Here, the spray openings 78 serve for targeted spraying of dissolved treatment agent mixture 61 onto the upper side of the housing 16 in the interior 28 of the appliance 10 to be cleaned, e.g. a steamer or an oven, as illustrated in FIGS. 1 and 2.

Two types of spray opening 80, 54 are provided in the central region 56 of the housing 42. The spray openings 80 serve for uniform wetting of the side walls of the housing 42 of the interior 28 of the appliance 10 to be cleaned, e.g. a steamer or an oven, as shown in FIGS. 1 and 2. The spray openings 80 have a smaller diameter than the spray openings 54 enabling the rotary motion of the housing 42 and are recessed into the circumferential surface of the housing 42. As a result, the spray openings 80 produce a higher discharge speed or a higher pressure and hence better mechanical removal on the wall of the appliance 10 to be cleaned, e.g. a steamer or an oven. As a result, dirt deposited there is removed more effectively. This effect can also be enhanced by further spray openings (not shown), which can be arranged on the rotation elements 70 in a direction opposite to the rotation direction and have a smaller diameter than the spray openings 54. By virtue of this arrangement, the resulting discharge speed of the spray jets of the treatment mixture 61 is boosted further, further improving the mechanical removal effect of the spray jets on surfaces. On the other hand, however, the rotary momentum of the spray openings 54 is hardly weakened owing to the low volume flow.

The spray openings 54 are arranged in the rotation elements 70 and additionally produce the rotary motion. Spraying of dissolved treatment agent mixture 61 from the spray openings 54 produces a rotary motion which imparts a rotary motion to the cleaner cartridge 14 in rotation direction 60.

In addition, the cleaner cartridge 14 shown comprises a collecting screen 40 within the housing 42. This retains dirt particles, ensuring that only treatment agent mixture 61 or cleaning solution can pass through the collecting screen 40 and emerge via the collecting screen 40 into the interior 28 of the appliance 10 to be cleaned, e.g. a steamer or an oven. A membrane 41 or a dirt trap 84 at the inlet of the cleaner cartridge 14 prevents dirt particles and treatment agent mixture 61 from flowing back to the pump 22 and water supply 20, especially when the pump 22 is being operated cyclically.

FIGS. 6A and 6B show a fourth embodiment of the cleaner cartridge 14 with rotation elements 70.

A plan view of the cleaner cartridge 14 with rotation elements 70 is shown in FIG. 6A. The rotation elements 70 are attached to the circumference 44 of the housing 42 on mutually opposite sides of the cleaner cartridge 14. The rotation elements 70 have a blade shape, wherein spray openings 54 are in each case formed on one side in rotation direction 60 in the rotation elements 70, from which openings dissolved treatment agent mixture 61 is sprayed. As a result, a tangential force component is produced, which brings about a rotary motion 60 of the housing 42 relative to the receptacle 50 about the rotary bearing 76. The receptacle 50 having the external thread is accommodated non-rotatably in a threaded section or a latching arrangement that allows positive-locking connection on the upper side of the interior 28 of the appliance 10 to be cleaned, e.g. a steamer or an oven.

In FIG. 6B, the cleaner cartridge 14 is shown in a side view. The receptacle 50, which allows connection to the connection element 32 of the cleaning system 12, is provided on the head of the cleaner cartridge 14. The rotary bearing 76 allows the housing 42 of the cleaner cartridge 14 to rotate relative to the receptacle 50, which is mounted in a fixed manner. The rotation elements 70 comprise the spray openings 54, which spray the dissolved treatment agent mixture 61. These serve both to produce the rotary motion of the housing 42 by means of the emerging spray jets and to apply treatment agent mixture 61 to surfaces of the interior 28 of the appliance 10 to be cleaned, e.g. a steamer or an oven, which are to be cleaned.

In addition to the spray openings 54 in the rotation elements 70, further spray openings 80 are provided in the circumference 44 of the housing 42 in the central region 56. Through these spray openings 80, the treatment agent mixture 61 is sprayed into the interior 28 of the appliance 10 to be cleaned, e.g. a steamer or an oven, in order to partially dissolve dirt on the side walls of the housing 16 and to remove it by the mechanical action of the spray jets.

The cleaner cartridge 14 furthermore comprises a collecting screen 40 within the housing 42, which collects dirt particles from the returning dissolved treatment agent mixture 61. The dirt particles are retained by the collecting screen 40, thus ensuring that they are not redistributed in the interior 28 through the spray openings 54, 80. In addition, clogging of the spray openings 54, 80 is prevented. At the end of the cleaning operation, with the pump 22 switched off, the dirt particles form a sediment on the bottom of the collecting screen 40, while the dissolved treatment agent mixture 61 in the cleaner cartridge 14 emerges through the spray openings 54, 80 into the interior 28 and leaves the latter via the outlet 31.

FIG. 6C shows a variant embodiment of the cleaner cartridge in which the receptacle and the bearing journal form a single component.

As is evident from FIG. 6C, the bearing journal 66 and the receptacle 50 with the flat surface 65 form a single component. The receptacle 50 with the bearing journal 66 formed thereon is screwed to the connection element 32 of the cleaning system on the upper side of the interior 28 of the housing 16, for example, and is thus accommodated non-rotatably there. Along a supporting surface 67, which delimits an outer annular gap 86, the housing 42, which has the circumferential surface 44, can rotate relative to the receptacle 50 accommodated in a fixed manner. An outer annular gap 86 is delimited between the supporting surface 67 of the housing 42 and a projection of the receptacle 50.

In the variant embodiment shown in FIG. 6C, the spray openings (not shown here) that bring about the rotation of the housing 42 are in the circumferential surface 44 and impart rotation to the housing 42 about the rotary bearing 76.

FIG. 7 shows a variant embodiment of the cleaner cartridge having a positive-locking connection to the appliance to be cleaned, that is to say, for example, the appliance 10 to be cleaned, e.g. a steamer or an oven.

As is evident from FIG. 7, water flows through the bearing journal 66. The flow passes through the cartridge head 48, which has a fluid flow taper 92, into the interior of the housing 42 of the cleaner cartridge 14, which is bounded laterally by the circumferential surface 44. The spray openings 54 which produce the rotation of the housing 42 are situated in this surface. Moreover, at least one further spray opening 52, through which the treatment mixture 61 emerges into the interior 28 of the appliance 10 to be cleaned, e.g. a steamer or an oven, which is not shown here, is situated on the underside 46 of the housing 42 of the cleaner cartridge 14.

The flat surface 65 of the housing 42 is wetted by a fluid film 90. This forms by virtue of the fact that a fluid guide 88 is formed on the lower end of the bearing journal 66, diverting a partial flow of the water flow passing through the bearing journal 66 and guiding it around the cartridge head 48, thus causing said fluid film 90 to form on the flat surface 65. This fluid film serves to reduce the friction between the housing 42 of the cleaner cartridge 14 relative to the support thereof on the bearing journal 66. In the variant embodiment shown in FIG. 7 too, the bearing journal 66, which can have an external thread for example, is screwed into the upper side of the housing 16, i.e. the interior 28 of the appliance 10 to be cleaned, e.g. a steamer or an oven, in order to connect it to the connection element 32 of the cleaning system 12, and is thus mounted in a fixed manner. In another embodiment, the cartridge head 48 of the cleaner cartridge can be inserted and secured directly in a bearing journal mounted in a fixed manner in the oven. By virtue of the positive-locking connection on the cartridge head 48, the housing 42 rotates relative to the bearing journal 66 arranged in a fixed manner in the housing, or arranged in the interior 28, and connected to the water supply.

In the case of the solution proposed according to the invention, a cleaner in solid form, whether in tablet form, as a powder or granules or in block form or in gel form, is preferably used as the treatment agent, wherein the treatment agent is dissolved to form a liquid treatment agent by supplying $H_2O$ within the cleaner cartridge 14 inside the appliance only after the start of the cleaning procedure. This represents a particularly convenient and safe use. In the case of the solution proposed according to the invention, the cleaner cartridge 14 is provided with at least one spray opening 54, which, apart from bringing about rotation of the housing 42 of the cleaner cartridge 14, also reaches problem areas of the soiled interior 28 in a targeted manner. The receptacle 50 allows connection of the cleaner cartridge 14 to the appliance 10 to be cleaned, e.g. a steamer or an oven, in each case before the cleaning procedure, wherein the cleaner cartridge 14 can be removed from the appliance 10 to be cleaned and disposed of after the cleaning operation.

By virtue of the fact that, on the one hand, the torque is maximized owing to the distance of the at least one spray opening 54 from the center of rotation of the housing 42 and, on the other hand, owing to the retention of the majority of the volume and hence of the mass in the vicinity of the center of rotation, the inertia opposing rotation is minimized, stable rotation can be achieved, even in the case of relatively large-volume cleaner cartridges 14.

Moreover, the solution proposed according to the invention is distinguished by the fact that the at least one spray opening 54 allows the targeted spraying of the treatment agent mixture 61 in order to assist mechanical removal. Thus, special spray openings 78 can be provided in the top of the cleaner cartridge 14, as can spray openings 52 which are directed from the underside 46 of the cleaner cartridge 14 at the bottom of the appliance 10 to be cleaned, e.g. a steamer or an oven, i.e. at the bottom delimiting the interior 28 to be cleaned. Targeted spraying of the roof is worthwhile, as is targeted spraying of the bottom of the interior 28 since the bottom region of the interior 28 serves as a collection point for dirt, e.g. grease, oils or sugar, running off the boundary walls of the interior 28 and is a region that can be cleaned only with very great difficulty.

The cleaner cartridge 14 has a three-dimensional body with a volume of 25 ml to 500 ml, preferably of 50 ml to 450 ml and particularly preferably from 50 ml to 300 ml, depending on the intended use.

FIGS. 8 and 9 show a variant embodiment of the cleaner cartridge in the form of a rotating spray arm.

As is evident from the plan view according to FIG. 8, the cleaner cartridge 14 in the variant embodiment according to FIG. 8 is in spray arm form 94. As a result, the spray openings 54 which ensure the rotary motion of the cleaner cartridge 14 in spray arm form 94 about the bearing journal 66 are at a relatively large distance from the axis of rotation of the cleaner cartridge 14. The cleaner cartridge in the form of the spray arm 94 as illustrated in FIG. 8 has a cartridge head 48 designed as a positive-locking connecting element which is formed on the upper end of the bearing journal 66. The supporting surface 67, which is of annular configuration, is situated at the lower end of the bearing journal 66. If the cartridge head 48 is inserted into the positive-locking receptacle 96, which is likewise illustrated in FIG. 8, there is, on the one hand, a connection between the cleaner cartridge 14 and the supply line 20 of the cleaning system 12; on the other hand, the cleaner cartridge in spray arm form 94 can rotate about the supporting surface 67, which, according to the illustration in FIG. 9, is situated at the lower end of the bearing journal 66 having the positive-locking connection on the cartridge head 48. The dissolved treatment agent mixture 61 emerges in the form of jets from the spray openings 54, which are situated on the mutually opposite longitudinal sides of the cleaner cartridge in spray arm form 94, and imparts rotation to the cleaner cartridge in spray arm form 94 about the bearing journal 66, which is mounted in a stationary manner on the positive-locking receptacle 96.

The illustrations according to FIGS. 10.1, 10.2 and 10.3 show a cleaner cartridge which is embodied as a two-chamber cartridge.

The two-chamber cartridge 98 illustrated in FIGS. 10.1 to 10.3 is a disposable cartridge, on the housing of which arm-shaped rotation elements 70 are arranged. As a result, the housing 42 of the two-chamber cartridge 98 can rotate around the bearing journal 66, which comprises a rotary bearing 76 (not shown specifically here). The bearing journal 66 is preferably provided with an external thread, which is, for example, screwed into a corresponding connection element 32 of the cleaning system 12 of the appliance 10 to be cleaned.

From the illustration according to FIG. 10.2, it can be seen that the two-chamber cartridge 98 designed as a disposable cartridge has a first, upper chamber 100 and a second chamber 102, which is separate from the latter and situated underneath it. Situated on each of the rotation elements 70, which are designed in the form of arms, on mutually opposite sides, are the spray openings 54, via which partially dissolved treatment mixture 61 emerges and imparts rotation to the housing of the two-chamber cartridge 98 about the rotary bearing 76 around the bearing journal 66.

Below the first chamber 100 there is a second chamber 102, which is closed by a plug 104, which allows retarded release of the treatment agent present in the second chamber or of the treatment agent mixture present there. The plug 104, which closes an opening formed in the bottom of the second chamber, is preferably formed by wax or some other substance that melts when the temperature increases or which dissolves better in the treatment agent mixture or water. Depending on the temperature prevailing in the interior of the appliance 10 to be cleaned, the plug 104 melts or is dissolved and exposes the opening situated in the underside of the second chamber 102, as illustrated in FIG. 10.3. As a result, the treatment agent stored in the second chamber 102 of the two-chamber cartridge 98 or the treatment agent mixture stored there enters the interior 28 of the appliance to be cleaned downward in a vertical direction, while the treatment agent mixture stored in the first chamber 100 enters the interior 28 of the appliance to be cleaned by emerging from the spray openings 54 situated in the rotation element 70.

Owing to depending on the temperatures prevailing in the interior 28, melting of the plug 104, which is preferably manufactured from wax or some other substance which melts when the temperature increases or dissolves better in the treatment agent mixture or water, is possible, allowing delayed release of the treatment agent mixture stored in the second chamber 102 of the two-chamber cartridge 98 to take place.

While the treatment agent stored in the first chamber 100 is connected directly to the cleaning system 12, the second chamber 102 contains a different treatment agent and has no connection with the first chamber 100. The treatment agent contained in the first chamber 100 is dissolved immediately after the start of the program, the treatment agent mixture 61 is formed and enters the interior 28 of the appliance 10 to be cleaned via the spray openings 54. Release of the treatment agent stored in the second chamber 102 situated underneath takes place when a desired temperature is reached, the plug 104 formed by wax melts and the product enters the interior 28 of the appliance to be cleaned in a vertical direction from the opening 106, which is then exposed.

The appliance to be cleaned can be rinsed between the phase of action of the first treatment agent mixture from the first chamber 100 and the phase of action of the second treatment agent mixture from the second chamber 102.

A two-chamber cartridge of this kind can contain a first treatment agent, e.g. an alkaline cleaning agent in the first chamber 100 and another alkaline cleaning agent or an acidic descaling agent in the second chamber 102, for example. Within a cleaning program of the cleaning system 12, it is thereby possible either to clean and descale the appliance 10 to be cleaned or to deep-clean it by means of two successive cleaning operations.

The invention is not restricted to the illustrative embodiments described here and to the aspects highlighted therein. On the contrary, a large number of modifications within the scope of action of a person skilled in the art is possible within the range indicated by the claims.

LIST OF REFERENCE SIGNS

10 appliance to be cleaned
12 cleaning system
14 cleaner cartridge
16 housing
18 door
20 supply line
22 pump
23 valve
24 valve
25 valve
26 control unit
27 spray opening
28 interior
30 connecting element
31 outlet in the bottom of the housing 16
32 connection element
33 outlet line
34 screen
36 water tank
38 return
40 collecting screen
41 membrane
42 housing
44 circumferential surface
46 underside
48 cartridge head
50 receptacle
52 spray openings
54 spray openings
56 central region
58 regular intervals between the spray openings
60 rotation direction
61 dissolved treatment agent mixture
62 screw-in direction
63 inner annular gap
64 annular gap
65 flat surface
66 bearing journal
67 supporting surface
68 screw coupling body
69 fluid passage opening
69.1 fluid gap
69.2 opening
70 rotation element
72 straight side
74 oblique side
76 rotary bearing
78 spray opening
80 spray opening
82 beveled region
84 dirt trap
86 outer annular gap
88 fluid guide
90 fluid film on flat surface 65
92 fluid flow taper
94 cleaner cartridge in spray arm form
96 positive-locking receptacle
98 two-chamber cartridge
100 first chamber
102 second chamber
104 plug
106 exposed opening

The invention claimed is:

1. A cleaner cartridge for cleaning an interior of a soiled interior of an appliance, comprising:

an integral housing having a circumference for holding a cleaning agent, at least one receptacle for connecting the cleaner cartridge to a water supply, wherein water can be introduced into the housing via the at least one receptacle at a pressure which enables a cleaning agent mixture to be sprayed, and at least one spray opening for spraying a cleaning agent mixture, wherein the at least one spray opening is arranged as a rotation opening in the circumference of the housing in such a way that rotation is imparted to the cleaner cartridge as the cleaning agent mixture is sprayed, wherein the cleaner cartridge is designed as a disposable cartridge filled with cleaning agent, which stores a sufficient quantity of cleaning agent for at least one cleaning operation.

2. The cleaner cartridge as claimed in claim 1, wherein the at least one receptacle is designed as a fixed receptacle.

3. The cleaner cartridge as claimed in claim 1, wherein the housing is embodied as a cylinder with a circumferential surface, a cartridge head and an underside.

4. The cleaner cartridge as claimed in claim 3, wherein at least two spray openings acting as rotation openings are arranged in the circumferential surface of the housing in such a way that at least two jets oriented tangentially to the housing with opposite spray directions are produced during the spraying of the cleaning agent mixture.

5. The cleaner cartridge as claimed in claim 1, wherein the cleaning agent can be in any state of aggregation, in particular as a powder or granules, as a tablet, as a block, in liquid form or as a gel.

6. The cleaner cartridge as claimed in claim 1, characterized in that the housing is designed in such a way that an alkaline cleaning agent and an acidic descaling agent or a second alkaline cleaning agent are held simultaneously, being released in a retarded manner during the rotation of the housing in the interior.

7. The cleaner cartridge as claimed in claim 6, characterized in that the alkaline cleaning agent and the acidic descaling agent or the second cleaning agent are in tablet form with different solubilities.

8. An appliance defining an interior to be cleaned and having a cleaning system, the cleaning system comprising a connection element for accommodating the cleaner cartridge as claimed in claim 1, wherein the cleaning system accommodating the cleaner cartridge is disposed in the interior of the appliance.

9. The appliance as claimed in claim 8, wherein the cleaning system comprises at least one water supply in order to carry water under pressure into the cleaner cartridge, and an outlet in order either to discharge water from the interior or to feed it back into a cleaning process via a recirculation line.

10. A cleaner cartridge for cleaning an interior of a soiled interior of an appliance, comprising:

an integral housing for holding a cleaning agent, at least one receptacle for connecting the cleaner cartridge to a water supply, wherein water can be introduced into the housing via the receptacle at a pressure which enables a cleaning agent mixture to be sprayed, and at least one spray opening for spraying a cleaning agent mixture, wherein the at least one spray opening is arranged as a rotation opening in the circumference of the housing in such a way that rotation is imparted to the cleaner cartridge as the cleaning agent mixture is sprayed, wherein at least two spray openings acting as rotation openings are arranged in the circumferential surface of the housing in such a way that at least two jets oriented tangentially to the housing with opposite spray directions are produced during the spraying of the cleaning agent mixture.

11. The cleaner cartridge as claimed in claim 10, wherein the at least one receptacle is designed as a fixed receptacle.

12. The cleaner cartridge as claimed in claim 10, wherein the housing is embodied as a cylinder with a circumferential surface, a cartridge head and an underside.

* * * * *